US006118215A

United States Patent [19]

Byrum et al.

[11] Patent Number: 6,118,215

[45] **Date of Patent: *Sep. 12, 2000**

[54] FLAT INTERNAL ELECTRODE FOR LUMINOUS GAS DISCHARGE DISPLAY AND METHOD OF MANUFACTURE

[75] Inventors: Bernard W. Byrum, Perrysburg; Robert E. Carter, II, Toledo; David M. Levison, Whitehouse, all of Ohio

[73] Assignee: Omnion Technologies, Inc., Millbury, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 09/130,861

[22] Filed: Aug. 7, 1998

[51] Int. Cl.[7] ..... H01J 61/067; H01J 61/32

[52] U.S. Cl. ..... 313/634; 313/491; 313/631

[58] Field of Search ..... 313/491, 346 R, 313/634, 635, 631, 632, 494

[56] References Cited

U.S. PATENT DOCUMENTS

| | | | |
|---|---|---|---|
| 3,563,797 | 2/1971 | Young et al. | 313/491 |
| 4,504,766 | 3/1985 | Kaneko | 313/634 |
| 4,924,137 | 5/1990 | Watanabe et al. | 313/346 R |
| 4,990,826 | 2/1991 | Cocks et al. | 313/491 |
| 5,479,069 | 12/1995 | Winsor | 313/493 |
| 5,479,071 | 12/1995 | Lynn | 313/514 |
| 5,585,694 | 12/1996 | Goldburt et al. | 313/491 |
| 5,767,618 | 6/1998 | Maya et al. | 313/493 |
| 5,811,925 | 9/1998 | Anandan et al. | 313/493 |
| 5,880,559 | 3/1999 | Fox et al. | 313/491 |

FOREIGN PATENT DOCUMENTS

| | | | |
|---|---|---|---|
| 2 313 704 | 12/1997 | United Kingdom | H01J 61/267 |

*Primary Examiner*—Michael H. Day
*Attorney, Agent, or Firm*—MacMillan, Sobanski & Todd, LLC

[57] ABSTRACT

A luminous gas discharge display including at least two opposing hermetically sealed plates. At least one of the plates is formed of a transparent material and cooperatively forms with at least one other plate at least one channel. The channel contains an ionizable gas to define a gas discharge path. The display further includes at least one pair of electrodes in communication with the at least one channel. At least one of the electrodes is a flat electrode positioned internally between the plates and includes a conductive material deposited on the channel and extending from the channel to outside the periphery of the display to provide electrical contact between a voltage source and the ionizable gas to produce a gas discharge display.

28 Claims, 3 Drawing Sheets

FLAT INTERNAL ELECTRODE FOR LUMINOUS GAS DISCHARGE DISPLAY AND METHOD OF MANUFACTURE

FIELD OF THE INVENTION

The present invention relates to a flat internal electrode for a luminous gas discharge display and a method of manufacture. More particularly, the present invention relates to a flat internal electrode for a luminous display such as a sign employing a gas discharge and a method of manufacture.

BACKGROUND OF THE INVENTION

Luminous signs employing a gaseous discharge and the methods for making these signs have been disclosed in several patents. In general, these signs are made by using two or three glass plates where in one or two of the plates is formed a groove or cavity corresponding to the desired display. The cavity is hermetically sealed and attached to a gas entry port incorporating a set of electrodes. In the manufacturing process the cavity is evacuated and a quantity of gas, such as neon, is introduced into the cavity through the gas entry port. The gas is then ionized by applying a voltage across the electrode set. The ionized gas, in turn, causes the display to illuminate. In a common alternate configuration, mercury may be added to the gas to create an abundance of UV radiation for exciting phosphors which produce visible light.

Heretofore, the electrodes typically consisted of a metal cylinder open on one end and enclosed in a glass tube and having a metal wire which passes through the glass tube to contact the metal cylinder. The electrodes must be prepared prior to use by heating the electrodes to a high temperature under vacuum sufficient to form a metal rich oxide film over the electrodes. The oxide film is of a type commonly associated with thermoionic cathodes, for example, primarily barium oxide. It will be appreciate that heating the electrodes decomposes the metal carbonates to form a metal rich oxide on the electrode surface. The electrodes are typically heated by applying an electric current between the electrodes. It will be appreciated that the metal oxide electrode surface requires formation at temperatures approaching 900 degrees Celsius. A gas discharge of a high current sufficient to cause heating of the electrodes to the necessary temperature is ignited typically using air. This approach is described in U.S. patent application Ser. No. 08/658,352, entitled "Luminous Gas Discharge Display", incorporated herein by reference.

Removing the contaminants from the sign improves the life of the sign. The contaminants which are removed during the formation of the electrode are best removed by heating the entire flat sign or tube. However, it will be appreciated that the process of forming the electrodes can also cause strong heating of the channel or tube and also cause breakage in the case of flat panel signs.

Although the many known variations of electrodes for luminous signs have been proven to perform satisfactorily, further improvements of electrodes for luminous signs and methods of manufacture are desired.

Accordingly, it is an object of the present invention to provide a flat electrode for a luminous gas discharge display and a method of manufacturing the flat electrode that overcomes problems of the prior art. For example, it is an object of the present invention to provide a method of manufacturing a flat electrode for a luminous gas discharge display that does not require intense heating of the electrode to produce the desired emissive surface. Yet another object of the present invention is to provide a flat electrode which is formed integral with the display between the plates forming the display. Another object of the present invention is to provide a flat electrode which produces a discharge in a suitable ionizable gas. Still another object of the present invention is to provide a durable flat electrode which is immune to typical vacuum contaminants and provides a long life performance. Another object of the present invention is to provide a method of manufacturing flat electrodes of a luminous gas discharge display that is simple and economical.

SUMMARY OF THE INVENTION

Briefly, the present invention relates to a luminous gas discharge display including at least two opposing hermetically sealed plates. At least one of the plates is formed of a transparent material and cooperatively forms with at least one other plate at least one channel. The channel contains an ionizable gas to define a gas discharge path. The display further includes at least one pair of electrodes in communication with the at least one channel. At least one of the electrodes is a flat electrode positioned internally between the plates. The electrodes are typically formed on the on at least one of the plates by printing, sputtering, physical vapor deposition, chemical vapor deposition or other suitable means of a type well known in the art. Each electrode includes a conductive material deposited in the channel to provide electrical contact between a voltage source and the ionizable gas to produce a gas discharge display.

In an alternate embodiment, an emission enhancing material may be added between the conductive material and the gas to enhance performance or mixed with the conductive material.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
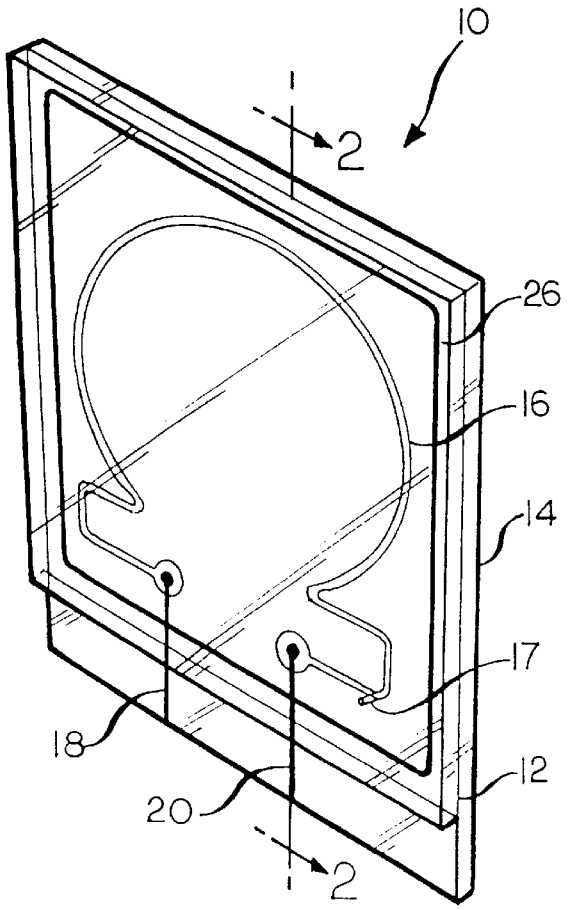
FIG. 1 is an isometric view of a luminous gas discharge display in accordance with the present invention.

Referring to the drawings, wherein like reference characters represent like elements, FIGS. 1–4 illustrate a gas discharge display 10. In considering the figures, it will be appreciated that for purposes of clarity certain details of construction are not provided in view of such details being conventional and well within the skill of the art once the invention is disclosed and explained. Furthermore, in the following description, it is to be understood that such terms as "front", "back", and the like, are words of convenience and are not to be construed as limiting terms apart from the invention as claimed.

Figure 4:
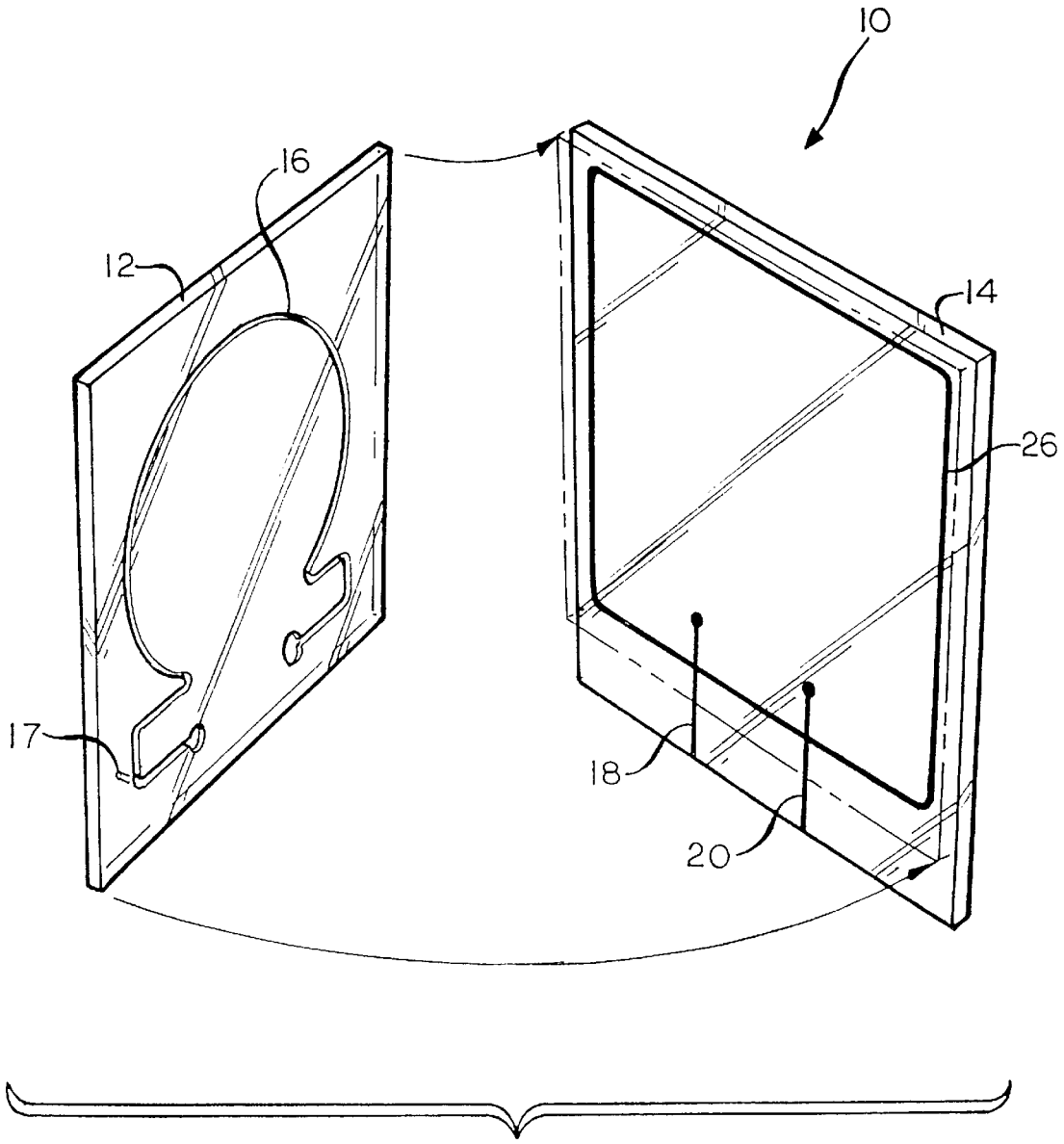
FIG. 4 is an exploded isometric view of the gas discharge display of FIG. 1 in accordance with the present invention.

Referring to the figures, the luminous gas discharge display 10 includes at least two opposing hermetically sealed plates 12 and 14. At least one of the plates forms at least one channel 16 containing an ionizable gas and defining a gas discharge path. In a preferred embodiment, as shown in FIG.4, a back plate 12 and a front plate 14 cooperatively form the at least one channel 16.

Figure 2:
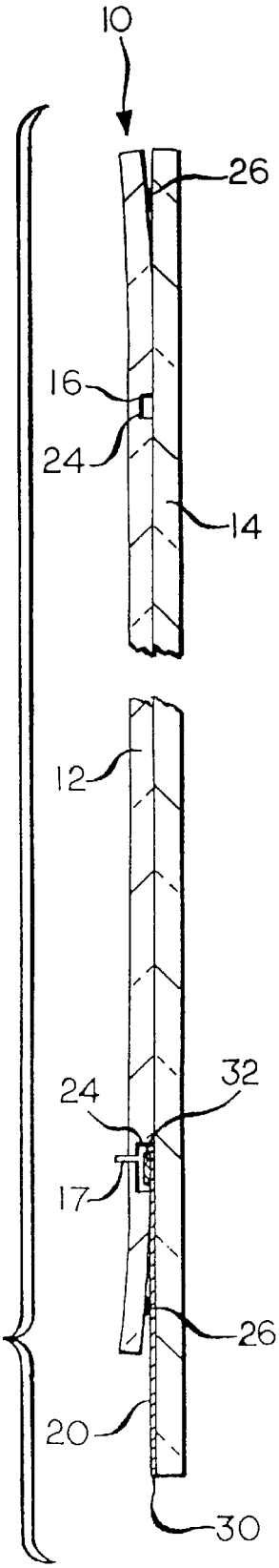
FIG. 2 is a partial cross-sectional view of the gas discharge display of FIG. 1 taken along line 2—2 of FIG. 1.

The plates 12 and 14 may be of most any suitable material to withstand temperatures and vacuum levels of a gas discharge, which may exceed 100 degrees Fahrenheit, and of most any suitable thickness and size. At least the front plate 14 of the display 10 is formed of a transparent material such as glass or plastic and the like. For example, the glass plate may be formed of soda-lime glass or flint glass and the like. The plates 12 and 14 may be of equal or unequal thickness and may be between about 1.5–12.7 mm thick. As shown in FIG. 2, the front plate 14 is larger than the back plate 12 to provide an electrical contact surface for the flat internal electrodes.

Figure 3:
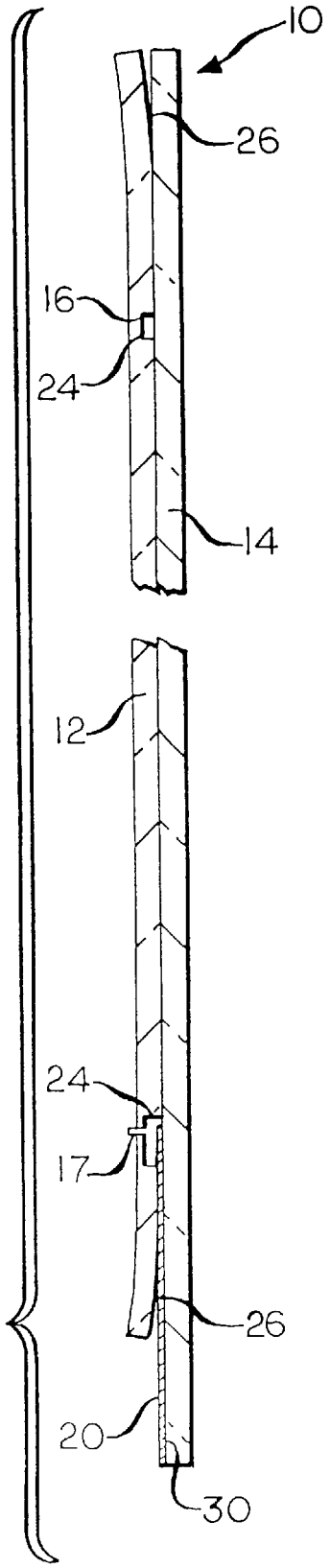
FIG. 3 is a partial cross-sectional view of the gas discharge display of FIG. 1 illustrating an alternate flat electrode configuration.

The channel 16 of the display 10 defines the gas discharge path. It will be appreciated that the channel 16 may be of most any suitable configuration and length as desired and does not extend through the plates except at the gas entry port 17. The channel 16 may be in the shape of a continuous tortuous path or in the shape of multiple independent paths configured to appear as letters or numbers. For illustrative purposes, the channel 16 is shown in FIGS. 1–3 in the shape of the Greek letter "Ω". It will be appreciated that to facilitate the appearance of separate and distinct figures or characters, the display 10 may include an optional opaque masking material (not shown) applied to one or more of the plates as well known in the art to mask the sections of the channel 16 interconnecting the figures or characters.

The channel 16 of the display 10 may be formed in the interior surface of one or more of the plates 12 and 14 by most any suitable means well known in the art including sand blasting or other mechanical means. In a preferred embodiment, the channel 16 is formed in one or more of the interior surfaces of the plates 12 and 14 by mechanical routing.

In one embodiment, after the channel 16 is formed in one or more of the interior surfaces of the plates 12 and 14 a coating of light-emitting phosphor 24 is applied to the channel. For example, the phosphor 24 may be applied to the channel by printing, spraying and painting using auto guided or manually guided sources. A technique known as "settling" may also be used. Settling is accomplished by filling the channel 16 with a suspension of phosphor and a vehicle such as denatured alcohol, and allowing evaporation to occur, during which the phosphor is deposited on the walls of the channel. The phosphor 24 produces the light color of the display 10 as required to improve the aesthetics of the display. The light-emitting phosphor 24 may be of most any suitable color and type as well known in the art.

The two plates 12 and 14 are sealed together using a low temperature sealing medium 26 of a type well known in the art such as a Ferro Corporation Frit or a Varian Corporation Torr Seal epoxy, or other suitable sealing medium. The low temperature sealing medium 26 affects a seal about the perimeter of the display 10 without affecting the desired optical transparency of the plates 12 and/or 14. The sealing medium 26 is placed about the entire outer perimeter of the display 10 to define an inner area circumscribing the channels 16 and an outer border area. In an alternate embodiment, the back plate 12 is hermetically sealed to the front plate 14 and aligned with the front plate so that any mirror image channels 16 formed in the respective plates match.

Positioned in communication with the at least one channel 16 are at least two electrodes. In accordance with one aspect of the present invention at least one of the electrodes is a flat internal electrode. In a preferred embodiment, both electrodes are flat electrodes. It will be appreciated that the flat electrodes 18 and 20 are prepared on the channel surface of at least one of the two plates 12 and 14 and extend from within the channel to the outer border area of the plate. The internal flat electrodes 18 and 20 are then sealed internally between the plates. The flat electrodes 18 and 20 may be of most any suitable size to ionize the ionizable gas contained in the channel. It will be appreciated that it is a feature of the present invention that the flat electrode 18 or 20 is incorporated on the channel internally between the plates 12 and 14 within the display thereby providing a low-profile luminous gas discharge display.

Each flat electrode 18 and 20 includes a conductive material 30. The conductive material 30 is deposited on the inner surface of plate 12 or 14. The conductive material 30 is a thin conductive material that readily adheres to the plate 12 or 14. The conductive material extends from within the channel to outside the periphery of the display to provide electrical contact between the voltage source (not shown) and the ionizable gas. In a preferred embodiment, the conductive material 30 is a metal material such as gold, silver, chrome, nickel, tin oxide, ITO (indium-tin-oxide) and the like as well known in the art. The conductive material is about 1–10 microns thick. The conductive material 30 may be deposited by printing or thin film deposition techniques as well known in the art.

Each flat electrode may also include an emission enhancing material. The emission enhancing material 32 may be deposited on the conductive material 30 or may be blended with the material forming the conductive material to form a mixture which is then deposited within the channel. The mixture includes about 10–50 mole percent emission enhancing material, preferably about 10–30 mole percent emission enhancing material and, most preferably about 30 mole percent emission enhancing material, the remainder comprising conductive material. The emission enhancing material 32 may be an insulative oxide material such as alkaline-earth metal oxides, e.g., magnesium oxide, or rare-earth metal oxides, e.g., yttrium oxide, and the like. In a preferred embodiment, the emission enhancing material 32 is applied to the conductive material as a layer about 0.01–0.1 microns thick to enhance a spray discharge. A thicker layer of emission enhancing material 32 of insulative oxides up to 1.0 micron is also effective in improving performance beyond the self performance of the conductive material 30. The emission enhancing material 32 may be deposited by printing, sputtering or E-beam physical vapor deposition as well known in the art.

In another embodiment of the present invention, the emission enhancing material may be a diamond-like carbon film material formed from graphite as well known in the art. In a preferred embodiment, the diamond-like film carbon material is about 0.01–1.0 microns thick. The diamond-like carbon film material may be deposited by laser ablation in vacuum, chemical vapor deposition or RF plasma as well known in the art.

As shown in FIGS. 2 and 3, the conductive material 30 is deposited on a portion of the plate 12 or 14 within the channel and extends outside of the area of the electrode seal in communication with the voltage source. Electricity to power the display 10 is supplied to the electrodes 18 and 20 by way of the conductive material from a voltage source such as a transformer or the like of a type well known in the art.

In operation of the gas discharge display 10 including a flat electrode having an emission enhancing material, the starting generally results from the impressed voltage between the conductive materials 30 of the flat electrodes 18 and 20. The impressed voltage is sufficiently high to strike a discharge between the flat electrodes 18 and 20 causing ionic bombardment of the emission enhancing materials 32 of the flat electrodes 18 and 20, and the ejection from the emission enhancing material 32 of sufficient electrons to permit the flow of an operating current. Ions impinge on the emission enhancing material 32 and positively charge the emission enhancing material thereby producing a field effect which enhances electron emission and produces a spray discharge for insulative oxide materials such as magnesium oxide and the like. The spray discharge minimizes the field immediately in front of the flat electrodes 18 and 20 and limits the kinetic energy of the incoming ions.

Operation of the gas discharge display 10 including a flat electrode not including an emission enhancing material is performed in a manner similar to that described above except that enhancement of electron emission and spray discharge does not occur.

Though the invention has been described and illustrated in connection with a luminous display 10, it is recognized that the invention may take other forms. For example, the invention may be back filled with xenon or argon/mercury gas and the like and supplied with light-emitting phosphors on the surface of the channel 16 to be used for general and commercial lighting, as a light source for photographic or x-ray viewing, or depending upon the thickness or size of the unit, for any general or specialized lighting requirement for which it may be appropriate. It will also be appreciated that when using a xenon rich gas mixture, the use of mercury to excite the phosphors as conventionally practiced is no longer necessary. However, when using a xenon gas mixture, i.e., up to about 100%, the means of enhancing electron emission requires modification. The work function for MgO is too high to allow auger transition related emission from bombarding xenon. The maximum value of the work function is about 5.5 electron volts. A suitable material is zirconium diboride. The zirconium diboride material may be added as a medium to fine powder (less than 50 microns) in the printed conductive material. Other similar materials may be found such as $LaB_6$ to provide the same effect. Where xenon gas is not used to generate UV, MgO or other suitable insulative oxides may be added to the conductive electrode material so long as it does not destroy the needed conduction of the material.

The patents, patent applications and documents referred to herein are hereby incorporated by reference.

Having described presently preferred embodiments of the present invention it will be appreciated that it may be otherwise embodied within the scope of the appended claims.

What is claimed is:

1. A gas discharge display comprising:

at least two opposing hermetically sealed plates, at least one of the plates formed from a transparent material and cooperatively forming with at least one other plate at least one channel, said channel containing an ionizable gas to define a gas plate at least one channel, said channel containing an ionizable gas to define a gas discharge path; and at least one pair of electrodes in communication with the at least one channel, with at least one of the electrodes being a flat electrode positioned internally between the plates at a first end of said channel, said flat electrode including a conductive material deposited within said channel and extending from the channel to outside the periphery of the display and the other electrode being positioned at an opposite end of said channel, said pair of electrodes adapted to provide electrical contact between a voltage source and said ionizable gas to produce to produce a gas discharge display.

2. The gas discharge display of claim 1 wherein said conductive material is a metal material.

3. The gas discharge display of claim 1 wherein said conductive material is selected from the group consisting of gold, silver, chrome, nickel, tin oxide, and ITO (indium-tin-oxide).

4. The gas discharge display of claim 1 wherein the flat electrode further comprises an emission enhancing material deposited on the conductive material.

5. The gas discharge display of claim 4 wherein said emission enhancing material is an insulative oxide material.

6. The gas discharge display of claim 4 wherein said emission enhancing material is an alkaline-earth metal oxide material.

7. The gas discharge display of claim 4 wherein said emission enhancing material is a magnesium oxide material.

8. The gas discharge display of claim 4 wherein said emission enhancing material is a rare-earth metal oxide material.

9. The gas discharge display of claim 4 wherein said emission enhancing material is a diamond-like film material.

10. The gas discharge display of claim 9 wherein said diamond-like film material is about 0.01–1.0 microns thick.

11. The gas discharge display of claim 4 wherein said emission enhancing material is deposited on a portion of the conductive material.

12. The gas discharge display of claim 4 wherein said emission enhancing material is about 0.01–0.1 microns thick.

13. The gas discharge display of claim 1 wherein said channel defines said display and further wherein said conductive material extends outside of said plates.

14. The gas discharge display of claim 1 wherein the flat electrode is a mixture of conductive material and an emission enhancing material.

15. The gas discharge display of claim 14 wherein the mixture includes about 10–50 mole percent emission enhancing material.

16. The gas discharge display of claim 14 wherein the mixture includes about 10–30 mole percent emission enhancing material.

17. The gas discharge display of claim 14 wherein the mixture includes about 30 mole percent emission enhancing material.

18. The gas discharge display of claim 14 wherein said emission enhancing material is an insulative oxide material.

19. The gas discharge display of claim 14 wherein said emission enhancing material is an alkaline-earth metal oxide material.

20. The gas discharge display of claim 14 wherein said emission enhancing material is a magnesium oxide material.

21. The gas discharge display of claim 14 wherein said emission enhancing material is a rare-earth metal oxide material.

22. A luminous gas discharge display comprising:

two opposing hermetically sealed plates, at least one of said plates formed from a transparent material and cooperatively forming with at the other plate at least one channel, said channel containing an ionizable gas to define a gas discharge path; and at least one pair of electrodes positioned between said plates and in communication with said at least one channel, with at least one electrode of the pair of electrodes being a flat electrode which is positioned at one end of said channel and includes a conductive metal material deposited within said channel and an emission enhancing material of an insulative oxide material deposited on said conductive material, said other electrode being positioned at an opposite end of said channel, said conductive metal material adapted to provide electrical contact between a voltage source and said emission enhancing material to ionize said gas and produce a gas discharge display.

23. The luminous gas discharge display of claim 22 wherein said metal conductive material is selected from the group consisting of gold, silver, chrome, nickel, tin oxide, and ITO (indium-tin-oxide).

24. The luminous gas discharge display of claim 22 wherein said emission enhancing material is an alkaline-earth metal oxide material.

25. The luminous gas discharge display of claim 22 wherein said emission enhancing material is a rare-earth metal oxide material.

26. The luminous gas discharge display of claim 22 wherein said emission enhancing material is a diamond-like film material.

27. The luminous gas discharge display of claim 26 wherein said diamond-like film material is about 0.01–1.0 microns thick.

28. The luminous gas discharge display of claim 22 wherein said emission enhancing material is about 0.01–0.1 microns thick.

* * * * *